United States Patent [19]

Allan

[11] 4,140,347

[45] Feb. 20, 1979

[54] FLUID OPERATED WALL GROOVE CUTTER

[75] Inventor: David T. Allan, Glasgow, Scotland

[73] Assignees: John MacDonald & Co. (Pneumatic Tools) Ltd.; David Thomson Allan, both of Great Britain

[21] Appl. No.: 760,531

[22] Filed: Jan. 19, 1977

[30] Foreign Application Priority Data

Jan. 27, 1976 [GB] United Kingdom ..... 3004/76

[51] Int. Cl.[2] ..... E21C 37/24

[52] U.S. Cl. ..... 299/38; 173/21; 173/112

[58] Field of Search ..... 299/37, 38; 125/6, 7; 51/241 S; 173/21, 22, 28, 112

[56] References Cited

U.S. PATENT DOCUMENTS

| | | | |
|---|---|---|---|
| 281,135 | 7/1883 | Rapp | 299/38 |
| 1,206,288 | 11/1916 | Ball | 299/38 |
| 1,587,949 | 6/1926 | Hansen | 173/112 X |
| 2,512,296 | 6/1950 | Berthiez | 173/21 |
| 2,672,331 | 3/1954 | Cornett | 299/37 X |
| 3,656,560 | 4/1972 | Catterfeld et al. | 173/12 |

FOREIGN PATENT DOCUMENTS

| | | | |
|---|---|---|---|
| 532782 | 11/1953 | Belgium | 299/37 |

*Primary Examiner*—Ernest R. Purser
*Attorney, Agent, or Firm*—Bertram Frank

[57] ABSTRACT

A hand-held groove cutter, particularly for cutting grooves in concrete structures, comprises a movable carriage having wheels for rolling over the concrete structure, and a fluid-operated percussion hammer mounted on the carrier. The hammer includes a piston and a cylinder which is mounted for sliding movement in a housing, and a tool which is connected to the piston. An adjustment arrangement is operative for moving the cylinder relative to the housing to thereby adjust the stroke of the piston and the depth of stroke of the tool.

9 Claims, 6 Drawing Figures

FLUID OPERATED WALL GROOVE CUTTER

This invention relates to fluid operated groove cutters.

In civil engineering and especially in the building of concrete structures it is normally necessary after the structure has been built to provide grooves in the walls, ceilings and floors through which can be led service pipes and conduits. In the past these grooves have generally been cut using a concrete saw to define the edges of the groove and by chipping out the centre of the groove with a pneumatic hammer. Alternatively, the groove has in the past been cut purely with the use of a pneumatic hammer in which event the groove tends to be ill-defined and it is unlikely to be straight. Both the above methods have the disadvantage of being extremely time-consuming.

An object of the present invention is to provide a machine for cutting well defined grooves in concrete structures more quickly than by the methods mentioned above.

According to the present invention there is provided a hand-held fluid operated groove cutter, especially but not exclusively, for cutting grooves in concrete structures and comprising a carriage having concrete structure engaging wheels thereon adapted to run on the concrete structure, a fluid operated percussion hammer mounted on the carriage and including a piston and cylinder unit mounted in a housing and a tool connected to the piston of said unit, and means for adjusting the depth of stroke of the hammer relative to said wheels.

Preferably, said piston and cylinder unit includes a cylinder which is slidable in the housing so as to adjust the working depth of the hammer and thereby provide said adjustment means.

Preferably also, said cylinder is moved in the housing by an adjusting wheel connected to a screwed pin which co-operates with a threaded hole in the end plate of the cylinder.

Embodiments of the present invention will now be described, by way of example, with reference to the accompanying drawings, in which.

Figure 1:
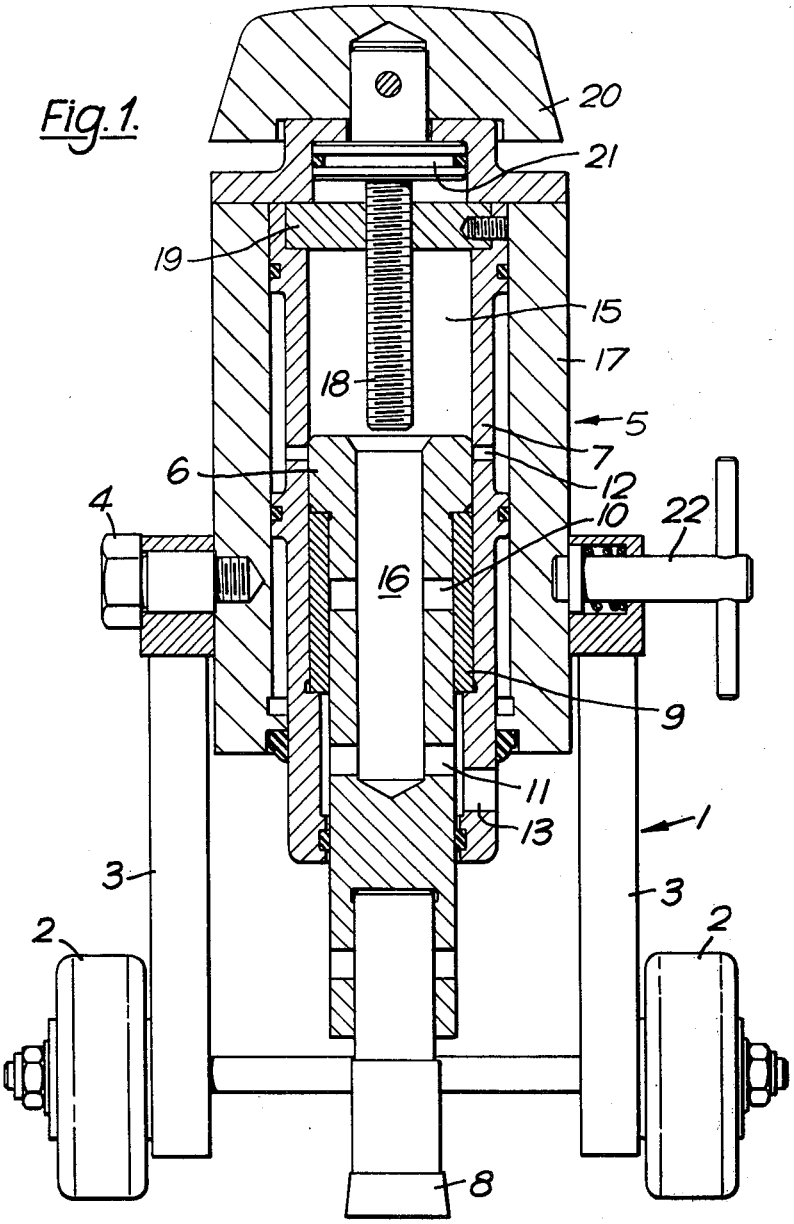
FIG. 1 is a sectional front view of a fluid operated groove cutter according to the invention.

Referring to the drawings a groove cutter comprises a carriage, indicated generally at 1, provided with four wheels 2 adapted to run on a separate structure (not shown). The carriage 1 comprises two saddles 3 which are substantially A-shaped and in which are mounted fixing members 4 for a percussion hammer indicated generally at 5.

Figure 2:
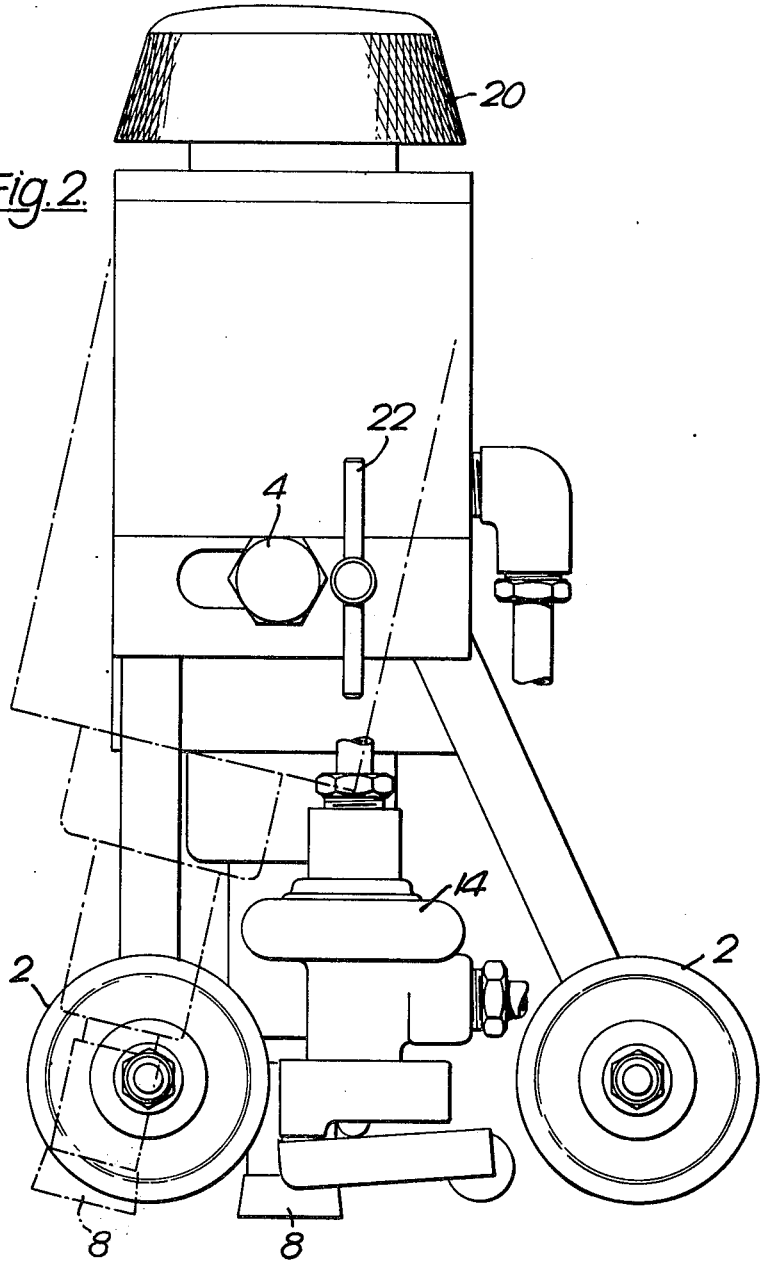
FIG. 2 is a side view corresponding to FIG. 1.

The hammer 5 has a piston and cylinder arrangement 6 and 7, the piston 6 having a tungsten tipped tool 8 connected to one end and moving through a liner 9 fitted within the cylinder 7. The liner 9 co-operates with ports 10,11 in the piston. An inlet port 12 is provided in the cylinder 7 and an exhaust 13 is provided to exhaust the cylinder to atmosphere. In operation, fluid, for example, air, under pressure is supplied to the inlet port 12 via a safety micro-valve 14 (FIG. 2). This fluid raises the piston 6 due to the fact that the upper chamber 15 of the cylinder is open to atmosphere via a central bore 16 in the piston and the ports 11 and 13. When the port 11 passes into the liner 9 the port 11 is closed and the port 10 opens the area under the piston to the chamber 15 through the bore 16. Due to the area differential of the top and bottom faces of the piston the latter is propelled downwards until the port 11 passes out of the liner 9 whereupon the cycle is repeated.

The cylinder 7 is contained in the bore of an outer housing 17 and the depth of stroke of the tool 8 is adjustable by varying the position of the cylinder 7 in the housing through a screwed pin 18 co-operating with a threaded hole in the end plate 19 of the cylinder 7. The pin 18 is connected to an adjusting wheel 20 which is retained on the end of the housing 17 by a thrust washer 21.

In the embodiment of FIGS. 1 and 2 the housing is pivotally mounted on the carriage so as to be movable between the position shown in full lines in FIG. 2 and the position shown in broken lines. This movement is accomplished by withdrawing a locking pin 22 from a first hole in the housing 17, pivoting the housing and re-locating the pin 22 in another hole. In the position shown in broken lines the tool bit is able to cut a groove into the corner of a crevice such as that formed between the wall and ceiling of a concrete structure.

The carriage is provided with handles (not shown in FIGS. 1 and 2) to enable an operator to hold the cutter against a wall. With the wheels in contact with the structure the micro-valve 14 is opened so as to allow fluid into the piston and cylinder unit and begin cutting. Moreover, to assist the operator in cutting a straight groove at least one pair of the wheels are provided with a camber angle.

Figure 3:
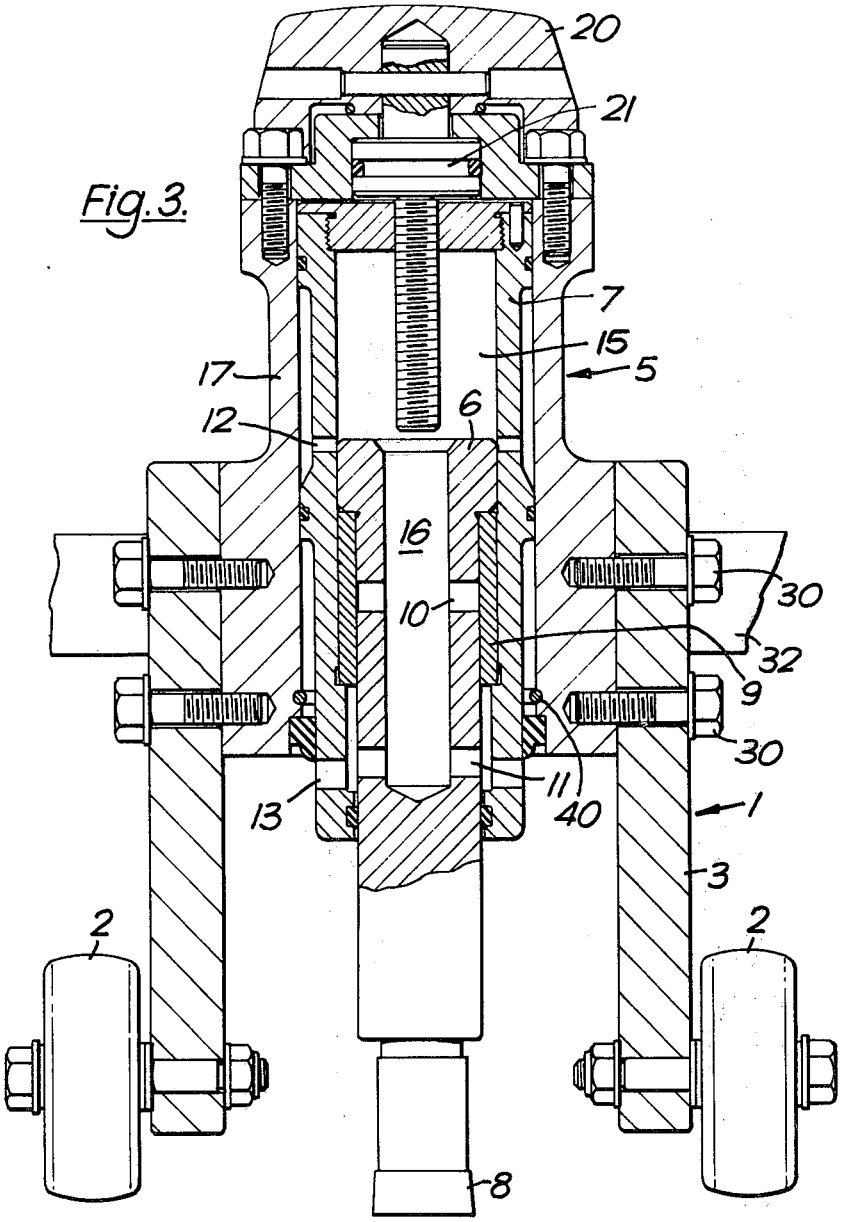
FIG. 3 is a sectional front view corresponding to FIG. 1 and showing a modified embodiment.
Figure 4:
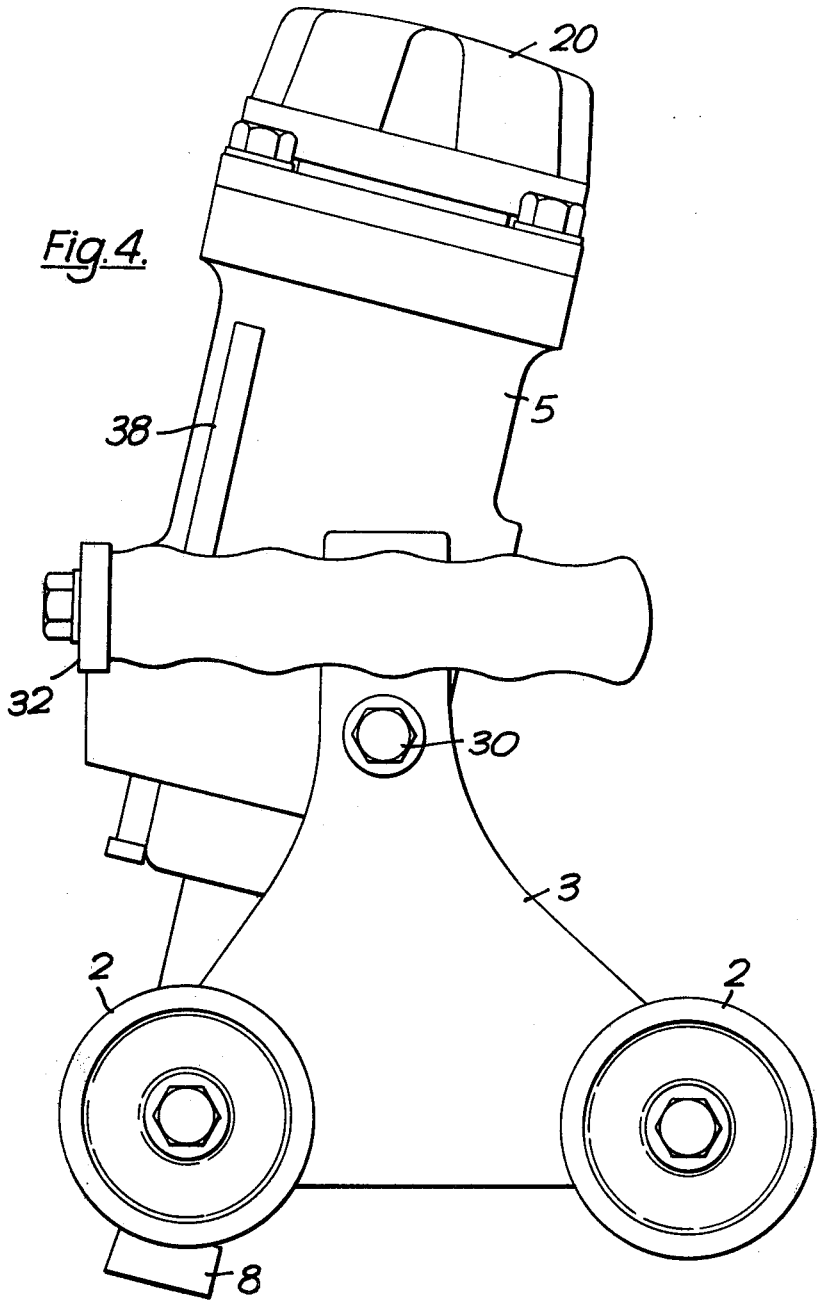
FIG. 4 is a side view corresponding to FIG. 3.
Figure 5:
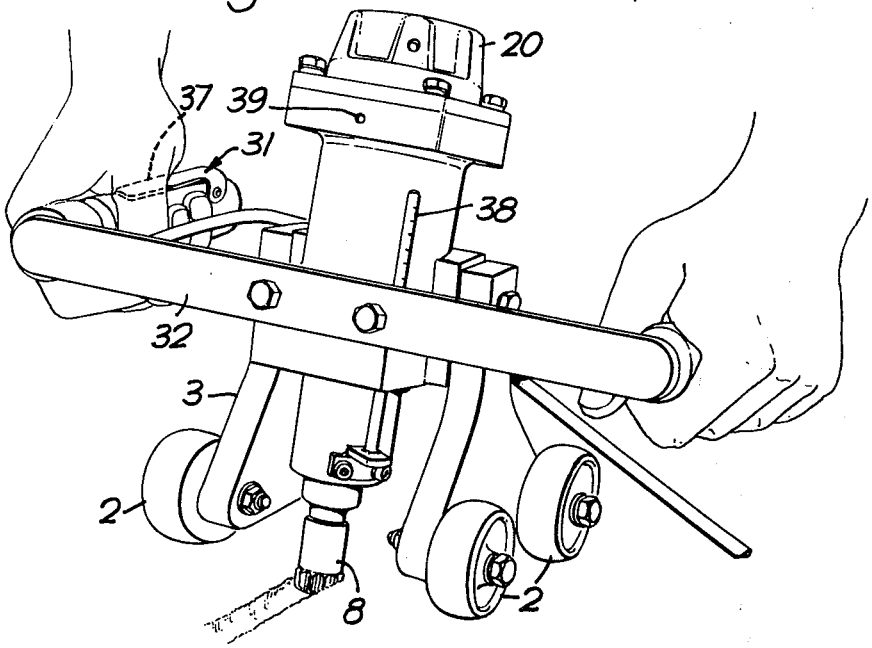
FIG. 5 is a perspective view showing the embodiment of FIGS. 3 and 4 in use.
Figure 6:
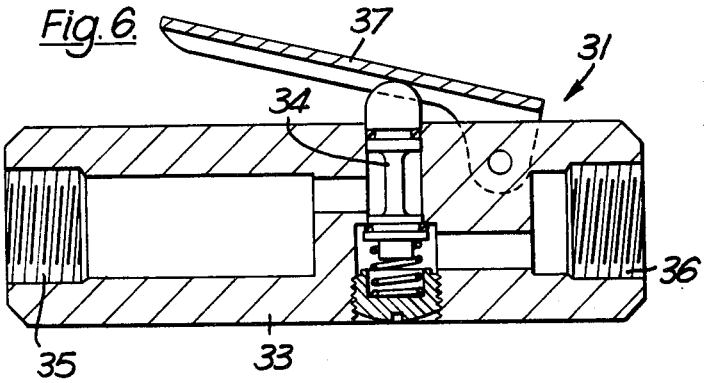
FIG. 6 is a sectional view of a valve.

Various improvements have been made in the embodiment shown in FIGS. 3 to 6, otherwise the groove cutters are identical and corresponding parts have been allocated the same reference numerals to those of FIGS. 1 and 2. In the embodiment of FIGS. 3 to 5 the housing is not pivotally mounted on the carriage but is secured at the angle shown in FIG. 4 (approximately 20° to vertical) by means of set pins 30. The valve 14 has been replaced by a hand operated squeeze grip 31 mounted on the handle 32. The valve 31 is shown in detail in FIG. 6 and comprises a body 33 with a cross-spool 34 mounted therein which is operated by a lever 37 and controls flow from an inlet 35 to an outlet 36.

A depth guide 38 is provided externally on the housing and an air bleed 39 connects the inside of the housing with the atmosphere so as to prevent a pressure build up in the housing. A circlip 40 is also provided to prevent accidental withdrawal of the cylinder from the housing.

The unit described above fitted with a ½" solid carbide tool bit will cut a ⅝" wide by ⅝" deep groove in a concrete structure at the rate of 6" per minute. With a ⅞" diameter tool bit the unit will cut a 1" wide by 1" deep groove at a rate of 1½" per minute. The depth of cut can be adjusted between zero and 1⅛" and the unit when powered by compressed air uses 15 c.f.m. free air at 85 p.s.i.g.

Further improvements or modifications may be made without departing from the scope of the invention, for example, the groove cutter could clearly be operated hydraulically.

I claim:

1. A hand-held fluid-operated groove cutter for cutting grooves in structures, especially but not exclusively in concrete structures, comprising a carriage; means for supporting said carriage in a predetermined position on an exposed surface of a respective structure for movement relative to the latter in a predetermined direction, including a plurality of wheels rotatably mounted on said carriage and engaging the exposed surface at engaging locations situated at least at the corners of an imaginary polygon; a fluid-operated percussion hammer including a housing mounted on said carriage, a piston mounted in said housing for reciprocation, and a tool connected to said piston for joint reciprocation and operative for penetrating beyond the exposed surface into the respective structure to cut a respective groove therein during the movement of the carriage in said direction; and means for adjusting the extent of penetration of said tool into the respective structure.

2. A groove cutter as defined in claim 1, wherein said hammer further includes a cylinder receiving said piston and mounted in said housing for displacement along the path of reciprocation thereof; and wherein said adjusting means is connected to said housing and to said cylinder and is operative for displacing the latter relative to the former.

3. A groove cutter as claimed in claim 2, wherein said adjusting means includes an adjustment member for sliding said cylinder relative to said housing to thereby adjust the stroke of said piston relative to said housing and concomitantly the stroke of said tool.

4. A groove cutter as defined in claim 2, wherein said cylinder includes an end plate having a threaded hole therein; and wherein said adjusting means includes an externally threaded pin mounted on said housing for turning and threadedly engaged in said threaded hole of said cylinder, and a handwheel located externally of said housing and connected to said externally threaded pin for joint rotation therewith.

5. A groove cutter as claimed 1; and further comprising means for supplying pressurized fluid to said hammer to operate the same, including a hand-operated squeeze grip valve operative for establishing and interrupting communication of said supplying means with said hammer.

6. A groove cutter as claimed in claim 1; and further comprising means for supplying pressurized fluid to said hammer to operate the same, including a safety valve mounted on said carriage and having an actuating portion contacting the respective structure maintaining said safety valve in its open position in said perdetermined position of said carriage, and releasing said valve for movement toward a closed position in any other than said predetermined position of said carriage.

7. A groove cutter as claimed in claim 1, wherein at least two of said wheels are mounted on said carriage in juxtaposition with one another transversely of said direction for rotation about respective axes which are inclined at a camber angle with respect to the respective structure.

8. A groove cutter as claimed in claim 1; and futher comprising means for mounting said hammer on said carriage for pivoting along a plane normal to the exposed surface of the respective structure and extending in said direction, between a first position in which said tool reciprocates substantially normal to the exposed surface, and a second position in which said tool reciprocates at an angle to the exposed surface for continuing the groove into crevices.

9. A groove cutter as claimed in claim 1; and further comprising means for so mounting said hammer on said carriage that said tool reciprocates at an angle of approximately 20° to a line normal to the exposed surface of the respective structure.

* * * * *